US009836024B2

(12) United States Patent
Di Domenico et al.

(10) Patent No.: US 9,836,024 B2
(45) Date of Patent: Dec. 5, 2017

(54) TIMEPIECE RESONATOR WITH CROSSED STRIPS

(71) Applicant: The Swatch Group Research and Development Ltd, Marin (CH)

(72) Inventors: Gianni Di Domenico, Neuchatel (CH); Baptiste Hinaux, Lausanne (CH); Laurent Klinger, Bienne (CH); Jean-Luc Helfer, Le Landeron (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/114,336

(22) PCT Filed: Dec. 14, 2015

(86) PCT No.: PCT/EP2015/079515
§ 371 (c)(1),
(2) Date: Jul. 26, 2016

(87) PCT Pub. No.: WO2016/096677
PCT Pub. Date: Jun. 23, 2016

(65) Prior Publication Data

US 2017/0010586 A1 Jan. 12, 2017

(30) Foreign Application Priority Data

Dec. 18, 2014 (EP) ..... 14199039

(51) Int. Cl.
*G04B 17/04* (2006.01)

(52) U.S. Cl.
CPC ..... *G04B 17/045* (2013.01)

(58) Field of Classification Search
CPC ..... G04B 17/04; G04B 17/045; G04B 17/06; G04B 17/20; G04B 17/26; G04B 17/28; G04B 13/025; G04C 3/101
See application file for complete search history.

(56) References Cited

U.S. PATENT DOCUMENTS 3,628,781 A * 12/1971 Grib ..... G01J 1/36 267/154
9,134,705 B2 * 9/2015 Vardi ..... G04B 15/08
(Continued)

FOREIGN PATENT DOCUMENTS

EP 2 645 189 A1 10/2013
EP 2 911 012 A1 8/2015
FR 1 573 518 A 7/1969

OTHER PUBLICATIONS

International Search Report dated Mar. 30, 2016, in PCT/EP2015/079515 Filed Dec. 14, 2015.
(Continued)

*Primary Examiner* — Sean Kayes
(74) *Attorney, Agent, or Firm* — Oblon, McClelland, Maier & Neustadt, L.L.P.

(57) ABSTRACT

A timepiece or watch includes at least one resonator, which includes at least one weight that oscillates with respect to a connecting element fixed to a structure of a timepiece movement. The weight is suspended from the connecting element by resilient crossed strips which extend at a distance from each other in two parallel planes. The projections of the strips on one of the parallel planes intersect at a virtual pivot axis of the weight, and define a first angle which is the apex angle opposite which there extends the portion of the connecting element that is located between the attachments of the crossed strips to the connecting element. The first angle is between 68° and 76°.

19 Claims, 5 Drawing Sheets

(56) References Cited

U.S. PATENT DOCUMENTS

| | | | | |
|---|---|---|---|---|
| 2015/0043313 | A1 | 2/2015 | Stranczl et al. | |
| 2015/0063082 | A1 | 3/2015 | Stranczl et al. | |
| 2015/0103636 | A1 | 4/2015 | Stranczl et al. | |
| 2016/0223989 | A1* | 8/2016 | Winkler | G04B 17/04 |
| 2017/0038730 | A1* | 2/2017 | Winkler | G04B 17/20 |

OTHER PUBLICATIONS

Barrot, "Un nouveau regulateur mecanique pour une reserve de marche exceptionnelle," Actes de la Journee D'Etude, 2014 (6 pages).

"Regulateur Genequand—une invention par Vaucher Manufacture Fleurier & le CSEM," URL: https://www.youtube.com/watch?v=U0FJxVY2Onk, 2014 (1 page).

* cited by examiner

Fig. 8
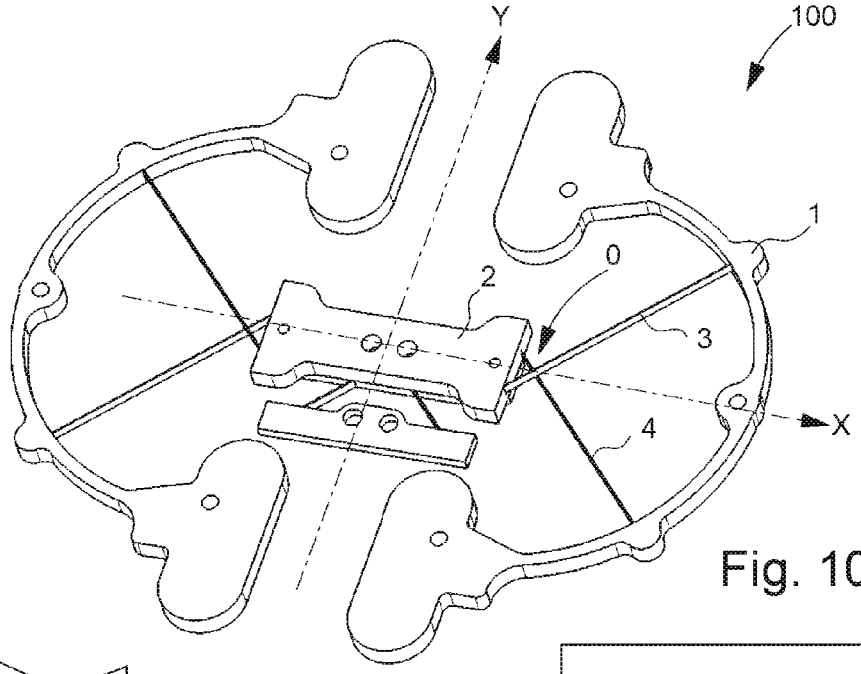
Fig. 10
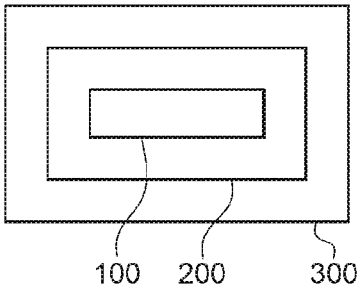
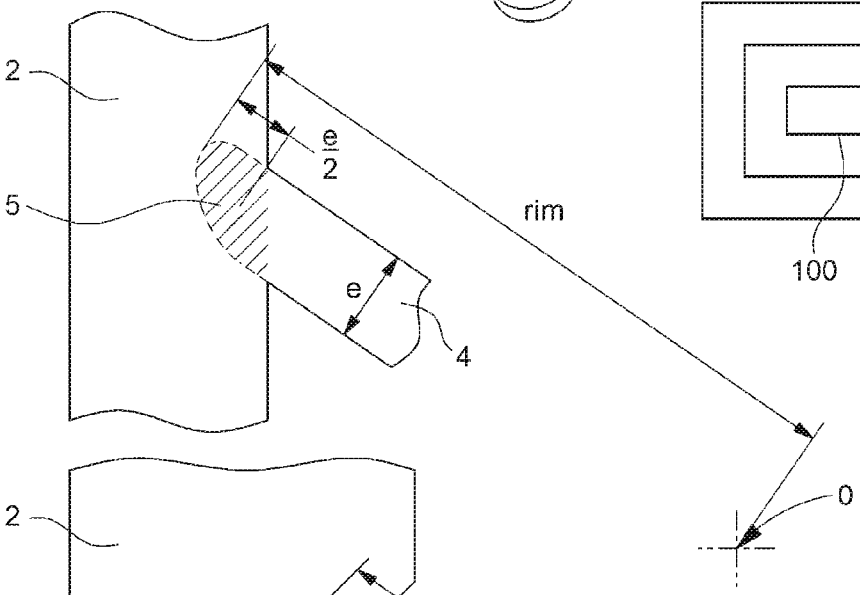
Fig. 9
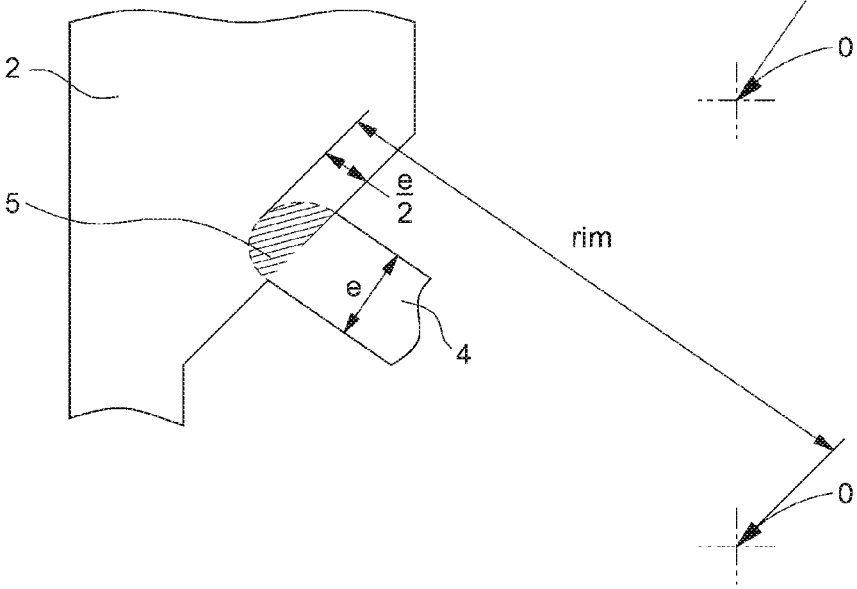
Fig. 9A

TIMEPIECE RESONATOR WITH CROSSED STRIPS

This is a National Phase Application in the United States of International Patent Application PCT/EP2015/079515 filed on Dec. 14, 2015 which claims priority on European Patent Application No. 14199039.0 filed on Dec. 18, 2014. The entire disclosures of the above patent applications are hereby incorporated by reference.

FIELD OF THE INVENTION

The invention concerns a timepiece resonator comprising at least one weight that oscillates with respect to a connecting element comprised in the resonator and which is arranged to be directly or indirectly secured to a structure of a timepiece movement, said at least one weight being suspended from said connecting element by crossed strips or beams which are resilient strips that extend at a distance from each other in two parallel planes, and the projections of the directions of said strips in one of said parallel planes intersect at a virtual pivot axis of said weight, and define together a first angle which is the apex angle, from said virtual pivot axis, opposite which there extends the portion of said connecting element that is located between the attachments of said crossed strips to said connecting element.

The invention also concerns a timepiece movement including such a resonator.

The invention also concerns a timepiece, in particular a watch, including such a movement, and/or such a resonator.

The invention concerns the field of time bases for mechanism timepiece mechanisms, in particular for watches.

BACKGROUND OF THE INVENTION

A balance wheel with crossed strips or beams is a resonator that can be used as a time base in a mechanical watch instead of a sprung balance.

The use of crossed strips or beams has the advantage of increasing the quality factor since there is no longer any friction at the pivot.

However, a balance with crossed strips has two significant drawbacks:

- the elastic return torque is non-linear, which makes the system anisochronous, i.e. the frequency of the resonator depends on the amplitude of oscillation;
- the centre of mass of the balance is subject to a residual motion which is due to the parasitic motion of the instantaneous axis of rotation. As a result, the resonator frequency depends on the orientation of the watch in the gravitational field; which is known as the position effect.

In the publication by F. Barrot, T. Hamaguchi, "*Un nouveau régulateur mécanique pour une réserve de marche exceptionnelle*", Proceedings of the 2014 Study Day of the Swiss Society of Chronometry, the authors disclosed an oscillator formed of a balance with crossed strips. They explain that "the implementation of a Wittrick type pivot is selected" in order to "make the oscillation frequency independent of the orientation of the balance with respect to gravity". This particular configuration where the strips intersect at seven eighths of their length was disclosed in the work of W. H. Wittrick, The properties of crossed flexure pivots and the influence of the point at which the strips cross>> The Aeronautical Quarterly II (4), pages 272 to 292 (1951). It has the advantage of minimising the displacements of the virtual axis of rotation and consequently of minimising the position effect. However, with a 90° angle between the two strips, the balance with crossed strips used in these works is highly anisochronous, which is why the authors used compensation via an additional component called the isochronism corrector. Experimental measurements show that such compensation is very difficult to achieve in practice and that it would therefore be very useful to find a geometry for the strips which negates both the position effect and the anisochronism caused by the non-linearity of the elastic return force.

EP Patent Application 2911012A1 in the name of CSEM discloses a rotating timepiece oscillator with a virtual pivot, with a balance that is connected by several flexible strips to a support, particularly in a one-piece embodiment. At least two flexible strips extend in planes perpendicular to the plane of the oscillator, and secant to each other in a straight line defining the geometric axis of oscillation of the oscillator; this axis crosses the two strips at seventh eighths of their respective length.

The configuration with the crossing point at seven eighths of length is already known to be optimum, in order to obtain an own and frictionless rotation about the virtual axis of oscillation, while minimising the displacement of this axis, in accordance with the work of W. H. Wittrick, University of Sydney, February 1951.

Although in this document EP 2 911 012 A1, it is envisaged that the strips emerge perpendicularly to the sides of a regular inner polygon with N sides, with a symmetry of order N about the virtual axis of oscillation, the only specific configuration illustrated is, however, that of an inner square, in which the two planes comprising the strips are perpendicular to each other. According to this document, the number of strips and their arrangement is defined by a compromise between the space allowed for the system, particularly from an aesthetic point of view, and the stability of the system. Apart from the seven eighths rule which is already known, there is no explicit mention in EP Patent Application 2911012 A1 of specific preferred geometric parameters for the best isochronism.

SUMMARY OF THE INVENTION

As the inventors observed, on the one hand, that the position effect depends very little on the angle between the two crossed strips and, on the other hand, that the anisochronism caused by the non-linearity of the elastic return force is highly dependent on said angle, they demonstrated by numerical simulation that it is possible to find an angular value that simultaneously optimises both the position effect and isochronism.

The invention therefore proposes to eliminate the drawbacks of the prior art by proposing an optimised geometry for the balance strips which negates both the position effect and the anisochronism caused by the non-linearity of the elastic return force. To this end, the invention concerns a timepiece resonator comprising at least one weight that oscillates with respect to a connecting element comprised in the resonator and which is arranged to be directly or indirectly secured to a structure of a timepiece movement, said at least one weight being suspended from said connecting element by crossed strips which are resilient strips that extend at a distance from each other in two parallel planes, and the projections of the directions of said strips in one of said parallel planes intersect at a virtual pivot axis of said weight, and define together a first angle which is the apex angle, from said virtual pivot axis, opposite which there extends the portion of said connecting element that is located between the attachments of said crossed strips to said connecting element, characterized in that said first angle is comprised between 68° and 76°.

The invention also concerns a timepiece movement including such a resonator.

The invention also concerns a timepiece, in particular a watch, including such a movement, and/or such a resonator.

BRIEF DESCRIPTION OF THE DRAWINGS

Other features and advantages of the invention will appear upon reading the following detailed description, with reference to the annexed drawings, in which:

FIG. 1 represents the general case where the crossed strips are anchored obliquely in the connecting element that carries them, which is attached to the structure of a timepiece movement.

FIG. 8 illustrates a variant where the resonator with crossed strips is a tuning fork resonator.

FIG. 9 is a detail showing, in dotted lines, the depth of the area of influence of flexure of a one-piece resilient strip with a connecting element made of micromachinable material in the case of FIG. 1.—FIG. 9A is the equivalent for FIG. 1A.

FIG. 10 is a block diagram showing a timepiece or a watch including a movement with a mechanism which in turn comprises such an oscillator.

DETAILED DESCRIPTION OF PREFERRED EMBODIMENTS

Figure 1:
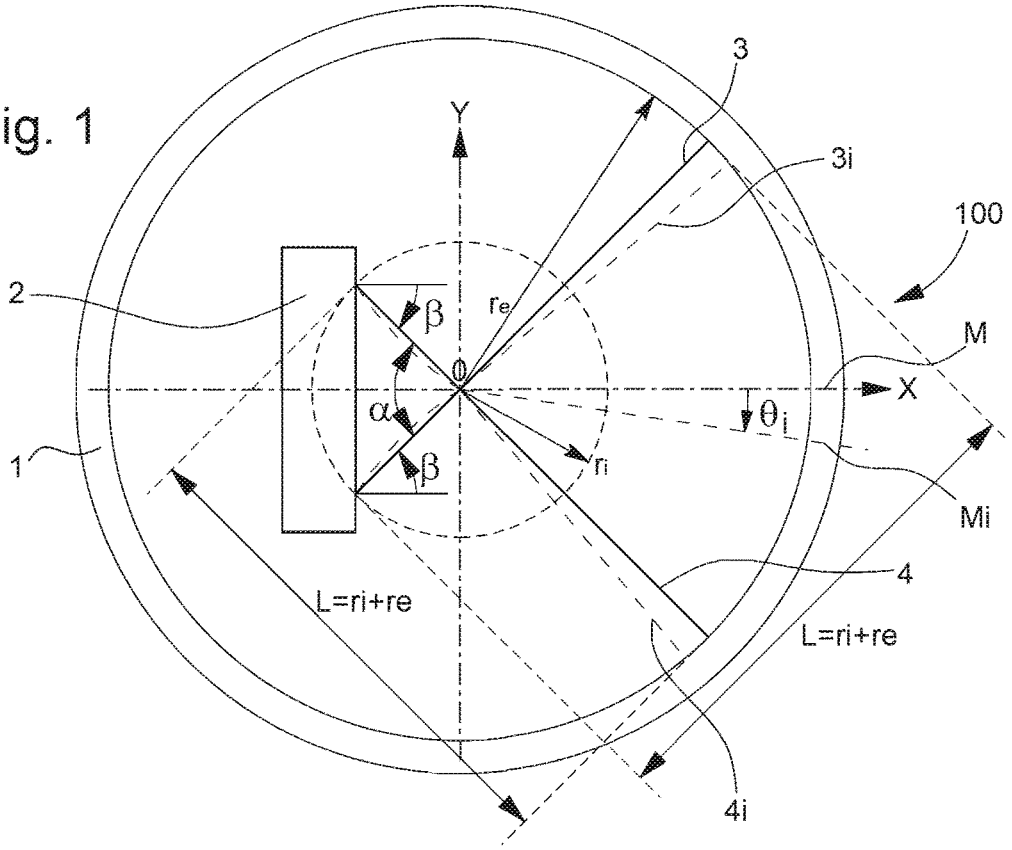
FIG. 1 shows a schematic plan view of a resonator having a balance with crossed strips, in a rest position shown in a solid line, and in an instantaneous position (with the crossed strips in dotted lines) where the balance is moved away from its rest position.

The term "centre of mass" used here may also be understood as the term "centre of inertia".

The invention concerns a timepiece resonator 100 including at least one weight 1 oscillating respect to a connecting element 2 comprised in the resonator. This connecting element 2 is arranged to be directly or indirectly attached to a structure of a timepiece movement 200.

This at least one weight 1 is suspended from connecting element 2 by crossed strips or beams 3, 4, which are resilient strips or beams that extend at a distant from each other in two parallel planes, and the projections of the directions of said strips in one of these parallel planes intersect at a virtual pivot axis O of weight 1, and define together a first angle α which is the apex angle, from this virtual pivot axis O, opposite which extends the portion of connecting element 2 that is located between the attachments of crossed strips 3, 4 to connecting element 2.

According to the invention, as will be explained hereinafter, this first angle α is comprised between 68° and 76°.

Figure 1A:
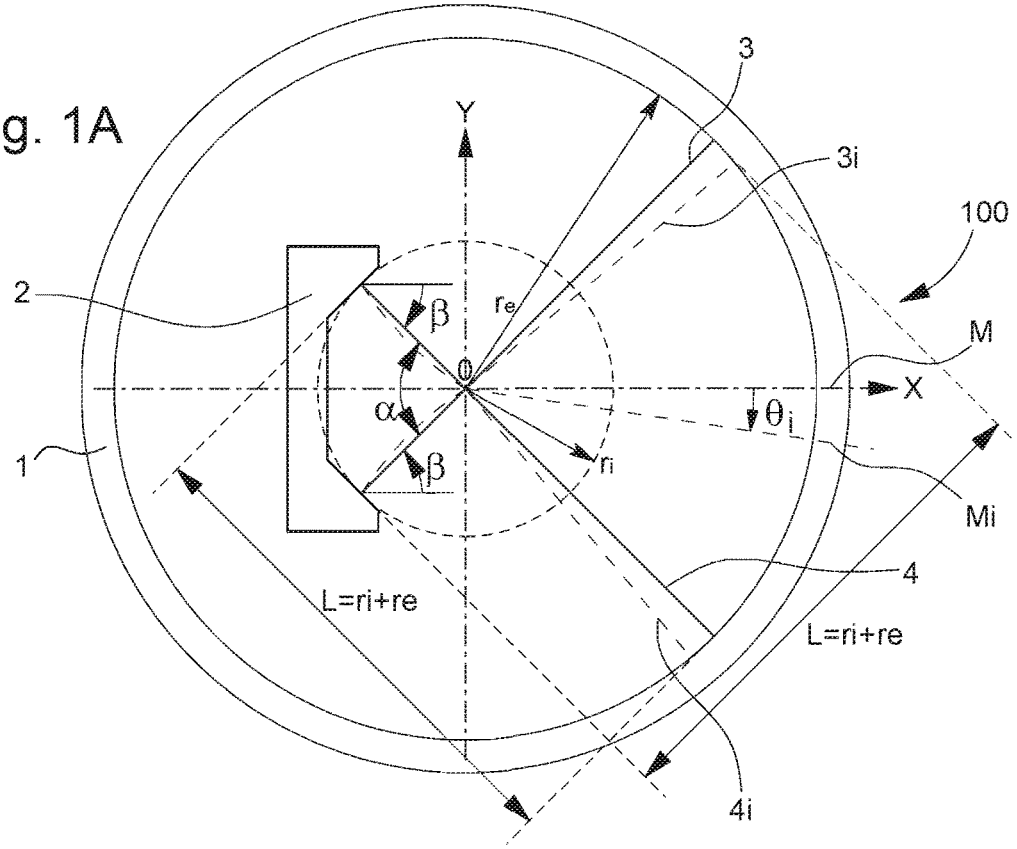
FIG. 1A shows a preferred configuration where the anchoring is achieved in a surface that is orthogonal to the end of each strip at the anchoring point thereof in the connecting element.

More specifically, and in a non-limiting manner, weight 1 is a balance wheel, as seen in FIGS. 1 and 1A, which illustrate, in solid lines, the geometry of a resonator 100 having a balance with crossed strips, in its rest position.

A balance 1 is held fixed to a connecting element 2 by two crossed strips 3 and 4. These crossed strips 3 and 4 are resilient strips which extend at a distance from each other in two parallel planes, and the projections of the directions of said strips on one of the parallel planes intersect at the virtual pivot axis O of balance 1. These crossed strips allow balance 1 to rotate, and substantially prevent the translation of balance 1 in the three directions X, Y, Z and also provide good resistance to small shocks. FIG. 1 shows the general case where the crossed strips 3, 4 are anchored obliquely in the connecting element 2 that carries them. FIG. 1A shows a preferred configuration where the anchoring is on a surface that is orthogonal to the end of each strip 3, 4 at its anchoring point.

The origin of coordinates O is placed at the intersection of strips 3 and 4 when resonator 100 is in its rest position. The instantaneous centre of rotation and the centre of mass of the balance are also located at origin O when the balance is in its rest position. The bisector of first angle α defines a direction X with which the projections of the two strips 3 and 4 in one of said parallel planes form an angle β which is half of first angle α.

In the preferred embodiment of FIG. 1, resonator 100 is symmetrical with respect to axis OX.

In the prior art, the first angle α has a value of 90°.

In FIG. 1, the inner radius ri is the distance between point O and the anchoring point of strips 3 and 4 in connecting element 2. The outer radius re is the distance between point O and the anchoring point of strips 3 and 4 in balance 1. It is to be noted that the roles of ri and re can be exchanged depending on whether the frame of reference used is that of the connecting element or that of the balance. All the following formulae remain valid since it is the relative notational motion that counts.

The total length L of each of the strips is, in this symmetrical construction, L=ri+re.

The first angle α is the angle between the two strips 3 and 4 when balance resonator 100 is in its rest position. This first angle α is the apex angle (at O) which defines the aperture of strips 3 and 4 with respect to connecting element 2, and opposite to which extends the portion of connecting element 2 that is located between the attachments of crossed strips 3 and 4 to said element.

The elastic return torque exerted by the strips on the balance can be written as M=k·θ, where k is the elastic constant and θ is the current angle made by balance 1 relative to its rest position. FIGS. 1 and 1A show an instantaneous value θi of current angle θ, corresponding to the deviation of a point M to its instantaneous position Mi, corresponding to flexed positions 3*i* and 4*i* of strips 3 and 4, shown in dotted lines in FIGS. 1 and 1A.

Since the torque is non-linear, the elastic constant varies with the angle of the balance k(θ)=M/θ.

Figure 2:
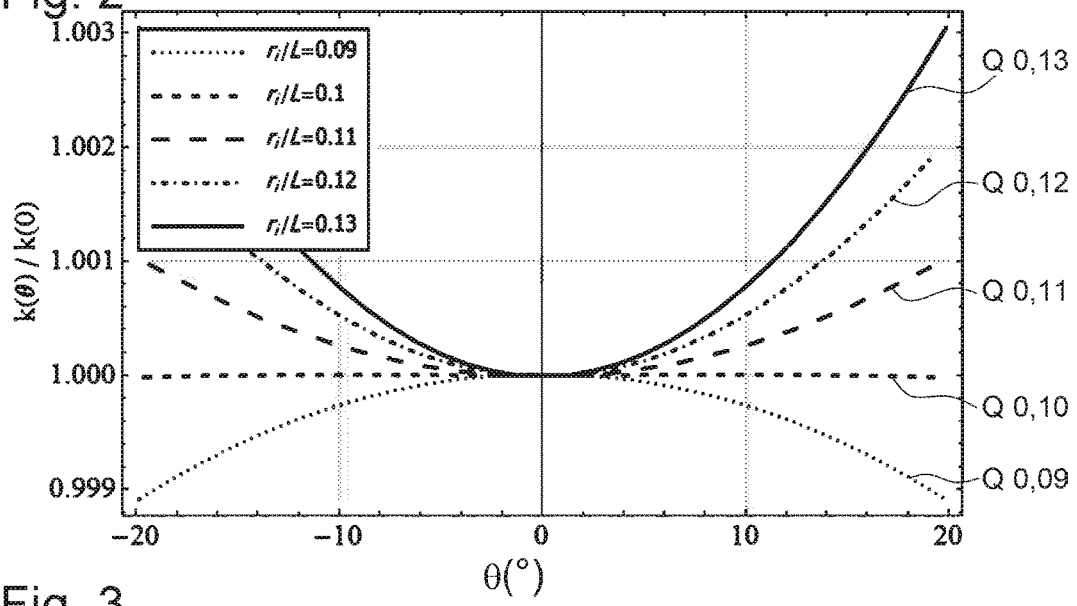
FIG. 2 is a graph representative of the prior art, where the crossed strips are perpendicular in the rest position of the resonator, illustrating the variation in elastic constant k on the ordinate, as a function of the current angle θ formed by the balance with its rest position on the abscissa.

The variation in elastic constant k as a function of the current angle θ of the balance is shown in FIG. 2 for the prior art. It is seen that the elastic return force is linear for the ratio Q=ri/L=0.10.

Figure 3:
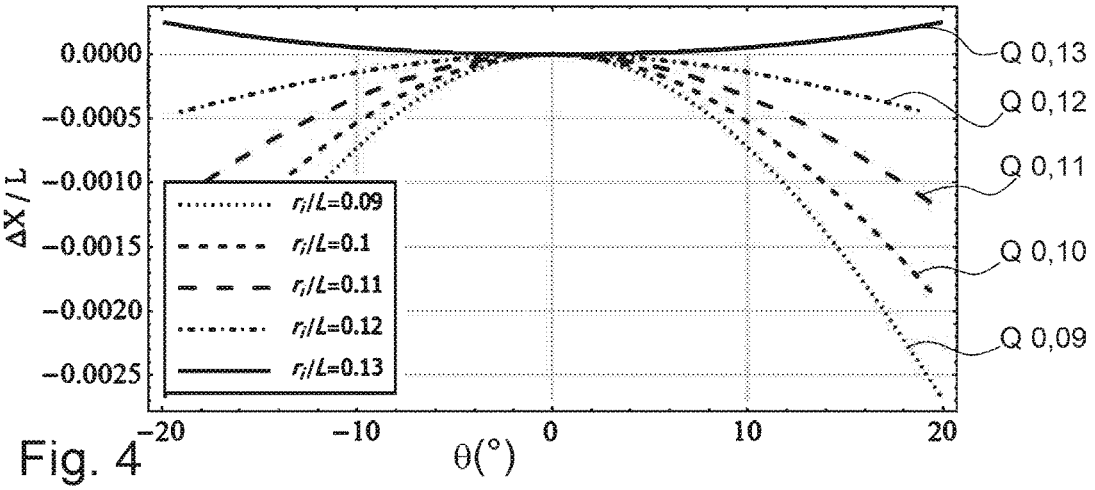
FIG. 3 and FIG. 4 are also graphs representative of the same prior art, and illustrate the variation in the centre of mass coordinates, respectively with respect to X and ΔX, in FIG. 3, and with respect to Y and ΔY, in FIG. 4 as a function of the current angle θ formed by the balance with its rest position on the abscissa. These variations in coordinates ΔX et ΔY are standardised with respect to the strip length L so that the graph have no units.
Figure 4:
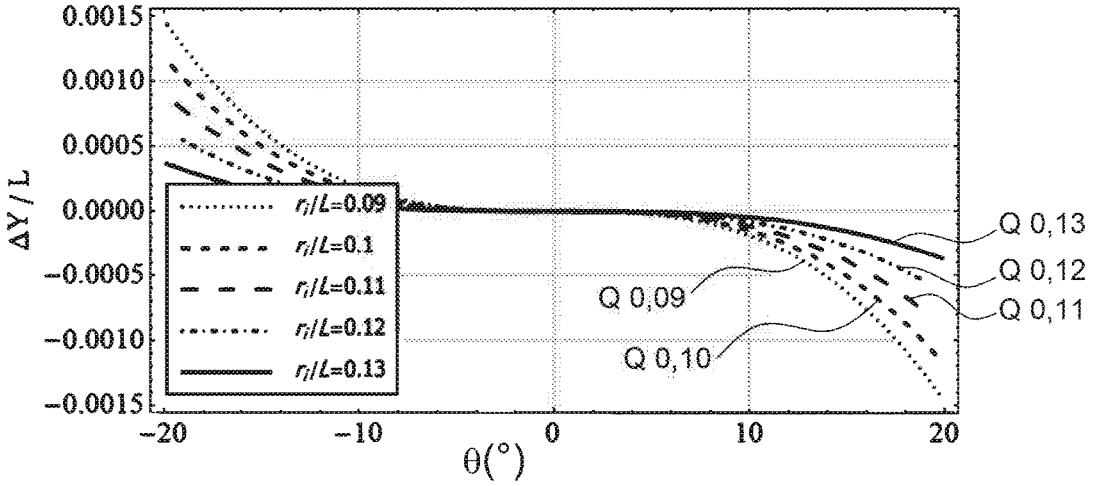

The displacement of the centre of mass of the balance (ΔX, ΔY) as a function of the angle of the balance θ is shown in FIGS. 3 and 4 for the same prior art. The different curves correspond to different Q=ri/L ratios. It is seen that, in the prior art, the displacement along X is minimum where ri/L is comprised between 0.12 and 0.13.

It is therefore observed, in all of FIGS. 2 to 4 representing the prior art, that there is no value of the ratio Q=ri/L for which there is simultaneously a linear return torque and a substantially zero displacement ΔX.

Consequently, in the prior art constructions, with α=90°, it is not possible to have a system that is simultaneously isochronous (linear elastic return force) and independent of position (zero displacement of the centre of mass along X).

The invention endeavours to determine a geometry for which such a resonator can be both isochronous and independent of position.

The study made within the scope of the invention can determine suitable values.

With a first angle α of 72° and with a ratio Q=ri/L comprised between 0.12 and 0.13, the system is simultaneously isochronous and independent of position.

Figure 5:
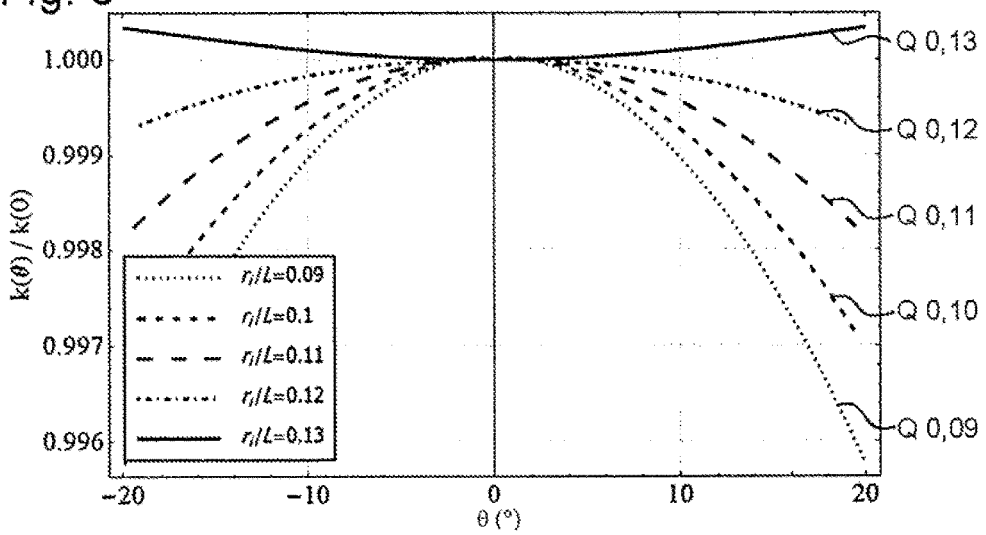
FIG. 5 is a graph representative of the invention, where the crossed strips form with each other a first angle α close to 72° in the rest position of the resonator, illustrating the variation in elastic constant k on the ordinate, as a function of the current angle θ formed by the balance with its rest position on the abscissa.

Indeed, with a first angle α close to 72°, the variation in elastic constant k as a function of the current angle θ of the balance is shown in FIG. 5. It is seen that the elastic return force is linear where the ratio Q=ri/L is comprised between 0.12 and 0.13.

Figure 6:
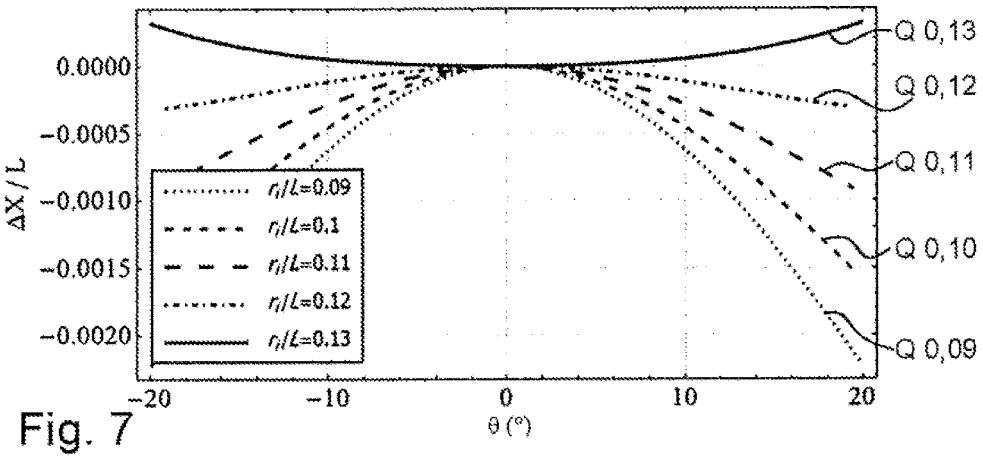
FIG. 6 and FIG. 7 are also graphs representative of the invention, where the crossed strips form with each other a first angle α close to 72° in the rest position of the resonator, and illustrate the variation in the centre of mass coordinates, respectively with respect to X and ΔX, in FIG. 6, and with respect to Y and ΔY, in FIG. 7 as a function of the current angle θ formed by the balance with its rest position on the abscissa. These variations in coordinates ΔX et ΔY are standardised with respect to the strip length L so that the graph have no units.

Likewise, with a first angle α close to 72°, the displacement of the centre of mass of the balance along X as a function of the current angle θ of the balance is shown in FIG. 6. The different curves correspond to different ri/L ratios. It is seen that the displacement along X is negated where Q=ri/L is comprised between 0.12 and 0.13.

It is therefore observed that, with a first angle α close to 72°, and a ratio Q=ri/L comprised between 0.12 and 0.13, there is simultaneously a linear return torque and zero displacement of the centre of mass along X, which is a considerable advantage.

Figure 11A:
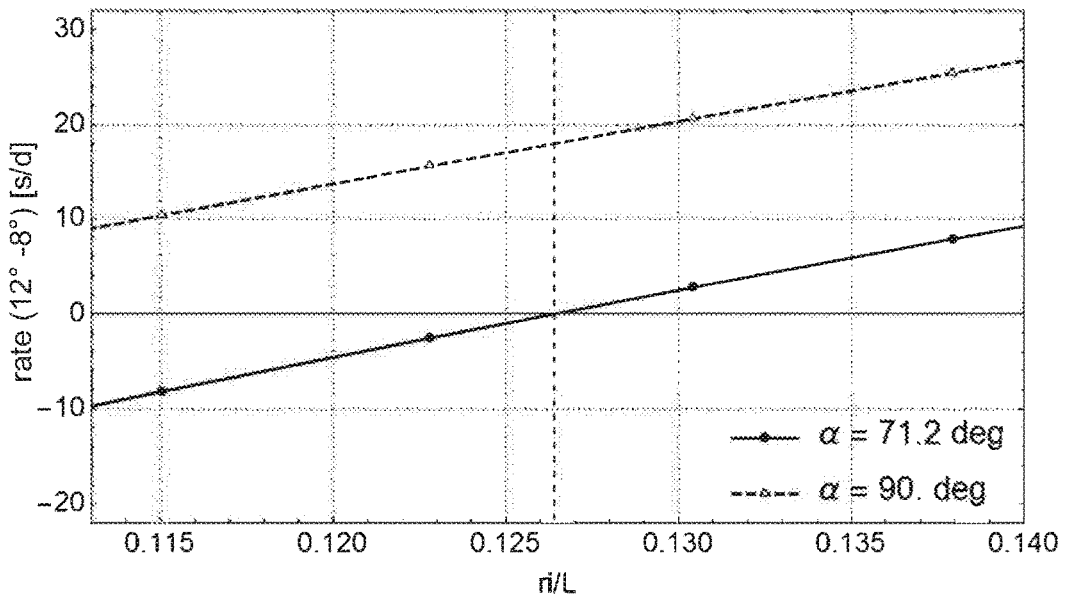
FIG. 11A is a graph illustrating the anisochronism of the balance with crossed strips as a function of the parameter Q=ri/L which makes it possible to compare the performance of the present invention (α=71.2°) to the prior art (α=90°). Anisochronism, measured in seconds per day (s/d) is the difference in rate observed for different amplitudes (the selected values of 12° and 8° are representative of the operating range of the system concerned).
Figure 11B:
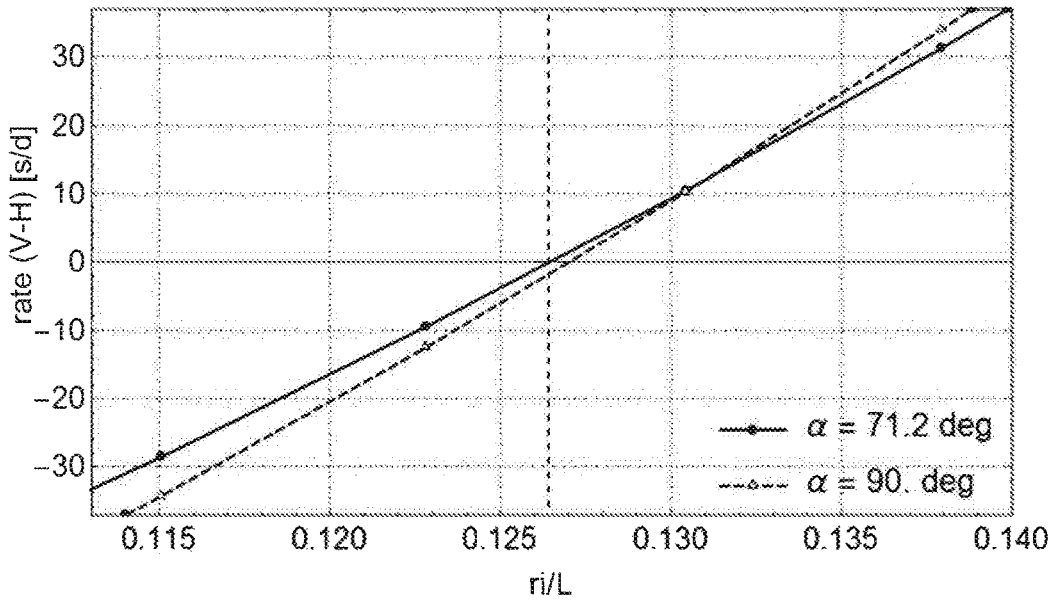
FIG. 11B is a graph illustrating the position effect on the rate of the crossed strip balance as a function of the parameter Q=ri/L for the present invention (α=71.2°) and for the prior art (α=90°).

This characteristic of the value of first angle α constitutes the essential characteristic of the invention, and is by no means fortuitious, since this value is the only value that can simultaneously guarantee isochronism and negate the position effect. To clearly illustrate this point, we have simulated the anisochronism of the balance with crossed strips, i.e. the difference in rate (in seconds per day) observed for two different amplitudes (we have chosen 12° and 8° which are representative of the operating range of the system concerned). The results are shown in the graph of FIG. 11A as a function of the parameter Q=ri/L, both for the prior art (α=90°) and for the present invention (α=72°). It is observed that the anisochronism greatly depends on angle α and the parameter Q=ri/L. The prior art, with a parameter Q=0.125 and an angle α=90°, is highly anisochronous since the variation in rate has a value of approximately 17 seconds per day. However, according to the present invention, the balance with crossed strips is isochronous with α=71.2°. For the sake of completeness, we also simulated the position effect on the balance with crossed strips, i.e. the difference in rate observed between the horizontal position (horizontal X and Y axes) and the vertical position (horizontal Y axis and X axis aligned with gravity). The results are shown in the graph of FIG. 11B as a function of the parameter Q=ri/L, both for the prior art (α=90°) and for the present invention (α=71.2°). It is observed that the position effect depends very little on angle α and the parameter Q=ri/L. This explains our approach which consists in using a to optimise iscochronism and Q to minimise the position effect. It is to be noted that the optimum value of Q=ri/L depends very little on angle α, it has a value of 0.1264 for the present invention (α=71.2°) and 0.1270 for the prior art (α=90°). Finally, it is important to note that the choice of α=71.2° is the only choice that can make the system both isochronous and independent of position.

In short, the prior art is very far from optimum isochronism, and the present invention consists in using a suitable angle value to achieve optimum isochronism.

In practice, this optimum geometric configuration may vary very slightly, as a function of the width of strips 3 and 4, and of the amplitude of oscillation of the balance, and of production tolerances.

FIGS. 9 and 9A illustrate a phenomenon which, depending on the nature of the crossed strip material, may very slightly modify the estimation of the total length L of strips 3 and 4: when the effect of the bending of the strips appears in the depth of the connecting element (in the case for example of a one-piece embodiment made of silicon or suchlike), it can be estimated that this depth corresponds to approximately half the thickness of the strip. It is then necessary to correct the value ri by replacing it with the value rim=ri+e/2, where e is the thickness of the strip 3 or 4 concerned.

The total length must consequently be corrected: Lm=ri+e/2+re, and ratio Q must be corrected in the same manner: Qm=(ri+e/2)/(ri+e/2+re), which must be comprised between 0.12 et 0.13.

In practice, suitable values of first angle α are comprised between 68° and 76°, and preferably as close as possible to 71.2°, and those of the ratio Q=ri/L are comprised between 0.12 and 0.13.

In a particular variant, resonator 100 is in one-piece.

More specifically, resonator 100 is made of micromachinable material producible by MEMS or LIGA technologies, or made of silicon or silicon oxide, or at least partially amorphous metal, or metallic glass, or quartz or DLC.

In one of these cases, it is the ratio Qm=(ri+e/2)/(ri+e/2+re), which must be comprised between 0.12 et 0.13. More specifically, this ratio Qm is chosen to be equal to 0.1264.

In an advantageous variant, the first angle α is comprised between 70° and 76°.

More specifically still, the first angle α is comprised between 70° and 74°. More specifically still, the first angle α is equal to 71.2°.

Figure 7:
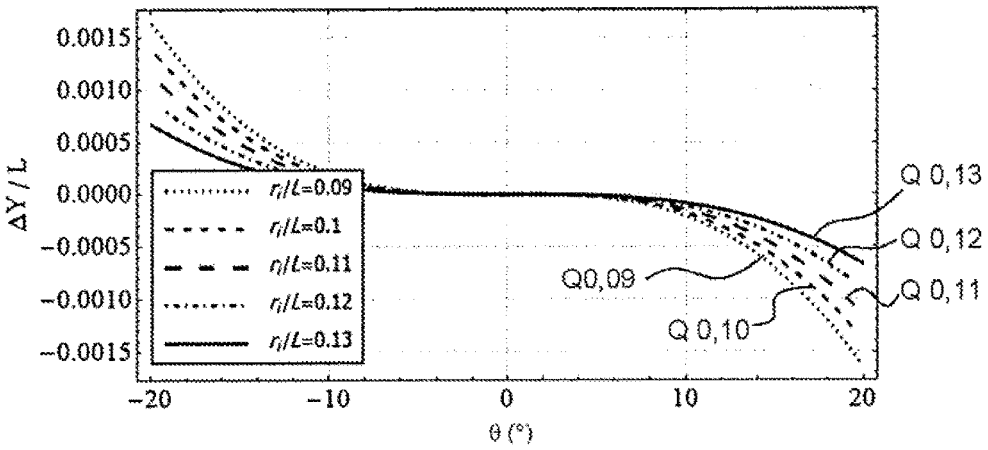

It is also noted that the displacement of the centre of mass along Y does not affect the rate of the resonator, due to the parity of the function ΔY(θ), as seen in FIG. 7. In other words, for this resonator having a balance with crossed strips, it is sufficient to negate displacement ΔX for the rate to be independent of position.

The invention also concerns a timepiece movement 200 including at least one such resonator 100.

The invention also concerns a timepiece 300, in particular a watch, including such a movement 200, and/or such a resonator 100.

The invention thus makes it possible to render a resonator having a balance with crossed strips simultaneously isochronous and independent of position.

The invention is applicable to other configurations of resonators with crossed strips, notably in a tuning fork structure, as seen in FIG. 8. The use of several oscillating weights is advantageous since it can minimise losses at the anchoring point. Indeed, a single balance causes a reaction force at the anchoring point and thus losses. It is possible to offset these losses by combining several oscillating weights an that the sum of their reactions at the anchoring point is zero. Particularly, resonator 100 may include at least two oscillating weights, notably two as seen in this Figure, whose opposing movements cause reactions at the anchoring point which compensate for each other. In this particular, non-limiting embodiment, two balances 1 are each held fixed to a common connecting element 2 by two crossed strips 3 and 4 arranged according to the characteristics described above. Here, resonator 100 is, advantageously, entirely symmetrical with respect to axis Y. Other variant embodiments are naturally possible.

The invention claimed is:

1. A timepiece resonator, comprising:

at least one weight oscillating with respect to a connecting element comprised in said resonator and which is arranged to be directly or indirectly secured to a structure of a timepiece movement, said at least one weight being suspended from said connecting element by crossed strips which are resilient strips that extend at a distance from each other in two parallel planes, and projections of the directions of said strips on one of said parallel planes intersect at a virtual pivot axis of said weight, and define together a first angle which is apex angle, from said virtual pivot axis, opposite which there extends the portion of said connecting element that is located between attachments of said crossed strips to said connecting element, wherein said first angle is comprised between 68° and 76°.

2. The resonator according to claim 1, wherein said first angle is between 70° and 76°.

3. The resonator according to claim 2, wherein said first angle is between 70° and 74°.

4. The resonator according to claim 3, wherein said first angle is equal to 71.2°.

5. The resonator according to claim 4, wherein said resonator includes at least two oscillating weights, in a tuning fork structure.

6. The resonator according to claim 1, wherein said strips are dimensioned with an inner radius ri between said virtual pivot axis and a point of attachment of said strips to said connecting element, with an outer radius re between said virtual pivot axis and a point of attachment of said strips to said weight, and with a total length L=ri+re, so that a ratio Q=ri/L, is between 0.12 and 0.13.

7. The resonator according to claim 6, wherein said ratio is equal to 0.1264.

8. The resonator according to claim 7, wherein said resonator includes at least two oscillating weights, in a tuning fork structure.

9. The resonator according to claim 1, wherein said strips are dimensioned with an inner radius ri between said virtual pivot axis and a point of attachment of said strips to said connecting element, with an outer radius re between said virtual pivot axis and a point of attachment of said strips to said weight, with a thickness e in the plane of each said strip, such that a ratio Qm=(ri+e/2)/(ri+e/2+re), is between 0.12 and 0.13.

10. The resonator according to claim 9, wherein said ratio is equal to 0.1264.

11. The resonator according to claim 10, wherein said resonator includes at least two oscillating weights, in a tuning fork structure.

12. The resonator according to claim 1, wherein, in projection on one of said parallel planes, said resonator is symmetrical with respect to the bisector of said first angle when the resonator is in the rest position.

13. The resonator according to claim 1, wherein said at least one weight is a balance wheel.

14. The resonator according to claim 1, wherein said crossed strips are each anchored in said connecting element on a surface of said connecting element which is orthogonal to an end of said strip concerned at an anchoring point thereof.

15. The resonator according to claim 1, wherein said resonator is in one-piece.

16. The resonator according to claim 15, wherein said resonator is made of silicon or of silicon oxide or of metallic glass or of quartz or of DLC.

17. A timepiece movement, comprising:

a structure to which is fixed, directly or indirectly, a least one connecting element comprised in said resonator according to claim 1.

18. A timepiece or watch, comprising:

the movement according to claim 17.

19. A timepiece or watch, comprising:

said resonator according to claim 1.

* * * * *